US008066424B2

(12) United States Patent
Ruscheweyh et al.

(10) Patent No.: US 8,066,424 B2
(45) Date of Patent: Nov. 29, 2011

(54) MIXING DEVICE

(75) Inventors: Hans Ruscheweyh, Aachen (DE); Stefan Leser, Neuss (DE); Michael Kaatz, Ratingen (DE)

(73) Assignee: Balcke-Durr GmbH, Ratingen (DE)

( * ) Notice: Subject to any disclaimer, the term of this patent is extended or adjusted under 35 U.S.C. 154(b) by 809 days.

(21) Appl. No.: 11/168,656

(22) Filed: Jun. 29, 2005

(65) Prior Publication Data

US 2006/0158961 A1 Jul. 20, 2006

(30) Foreign Application Priority Data

Jan. 17, 2005 (EP) ..... 05000811

(51) Int. Cl.
*B01F 5/04* (2006.01)

(52) U.S. Cl. ..... 366/174.1; 366/337

(58) Field of Classification Search ..... 366/174.1, 366/181.5, 336–338; 48/180.1, 189.4; 138/37, 138/40, 42, 44
See application file for complete search history.

(56) References Cited

U.S. PATENT DOCUMENTS

| | | | | |
|---|---|---|---|---|
| 4,498,786 | A * | 2/1985 | Ruscheweyh | 366/336 |
| 5,456,533 | A * | 10/1995 | Streiff et al. | 366/173.1 |
| 5,489,153 | A * | 2/1996 | Berner et al. | 366/337 |
| 6,015,229 | A * | 1/2000 | Cormack et al. | 366/336 |

FOREIGN PATENT DOCUMENTS

| | | |
|---|---|---|
| DE | 2911873 | 11/1980 |
| DE | 3043239 | 6/1982 |
| DE | 8219268 | 10/1982 |
| DE | 4211031 | 10/1993 |
| DE | 4325968 | 2/1995 |
| EP | 1170054 | 1/2002 |
| SU | 663593 | 5/1979 |

OTHER PUBLICATIONS

A. Schmidt, "Well Mixed", Feb. 2004, pp. 44-46, vol. 94, No. 2, Kunstoffe, Hanser, Munich, Germany.

* cited by examiner

*Primary Examiner* — David Sorkin
(74) *Attorney, Agent, or Firm* — Baker & Hostetler LLP

(57) ABSTRACT

The invention relates to a mixing device which is arranged in a flow channel and a mixing method for mixing a fluid flowing through the flow channel in a main direction of flow. The mixing device has a plurality of mixer disks which generate leading edge eddies in a fluid flowing through the flow channel in a main direction of flow. The mixer disks are arranged in mixer disk rows in row axes running essentially across the main direction of flow. The mixer disk rows are arranged side by side in the main direction of flow in a common flow channel section where the mixer disks of neighboring mixer disk rows are alternately angled in a positive angle of attack and in a negative angle of attack with respect to the main direction of flow.

According to this process, the fluid flowing through the flow channel is mixed thoroughly by a leading edge eddy system, whereby in the mixing method presented here at least two contra-rotating leading edge eddy systems are generated in a common flow channel section.

21 Claims, 4 Drawing Sheets

MIXING DEVICE

CROSS REFERENCE TO RELATED APPLICATIONS

This application claims priority to European Patent Application Serial No. 05000811.9 filed Jan. 17, 2005 entitled, MIXING DEVICES AND MIXING METHOD, the disclosure of which is incorporated by reference in its entirety.

FIELD OF THE INVENTION

This invention relates to a mixing device situated in a flow channel and having a plurality of mixer disks creating leading edge eddies in a fluid flowing through the flow channel in a main direction of flow. The mixer disks are arranged in mixer disk rows along row axes running essentially across the main direction of flow and the mixer disks of the respective mixer disk row are angled in the same way with respect to the main direction of the flow of the fluid.

BACKGROUND OF THE INVENTION

In addition, this invention relates to a mixing method for mixing a fluid flowing in a main direction of flow through a flow channel, whereby the flow of the fluid is thoroughly mixed by a leading edge eddy system.

Such mixing devices and mixing methods are used in industrial plants, power plants, chemical plants, roasting mills and similar plants to mix or blend the fluid flows occurring there. For example, for exhaust gas purification, the exhaust gases must be mixed to achieve a uniform utilization and effective operation of the cleaning facilities.

A mixing device development by the applicant in this regard is the so-called static mixer in which thin mixer disks are arranged so the flow can pass freely by them in a flow channel. The mixer disks are inclined at an acute angle, also referred to as the oncoming flow angle, with respect to the flow. Then a particularly stable leading edge eddy system develops on the back of these mixer disks facing away from the flow. This leading edge eddy system consists essentially of two contra-rotating eddies from the free front and side edges, where the flow passes freely by them toward the inside and widening conically in the main direction of flow. These eddy pairs in the form of bags are also referred to in aviation engineering as eddy drag; they are very powerful and create a good mixing effect within a short mixing zone downstream of the mixer disk, also known as eddy induction disks or baffles with the very low slope of the mixer disk with respect to the main direction of flow. Because of the especially acute oncoming flow angle of the mixer disk in comparison with other mixer devices, there is only an extremely slight increase in flow resistance. Therefore, the pressure drop in this mixing device is especially low in comparison with that of other known systems.

So-called transverse mixers are used in the flow channels of the aforementioned installations, where these channels are frequently very broad. These transverse mixers equalize the temperature distribution, the chemical composition in the exhaust gases and the dust distribution, e.g., the flue ash, based on the principle of action of the static mixer. With these transverse mixers, multiple eddy induction disks are arranged along a row axis in a mixer disk row. The row axis of this mixer disk row runs essentially across the main direction of flow.

To further improve the uniformity of the flow, the present applicant has already proposed mixers in which multiple mixer disk rows of this type are arranged one after the other in the direction of flow. The second row is a minimum distance from the first row of mixer disks, which depends on the eddy formation produced by the first row. The second mixer disk row is thus arranged behind the first row so that the mixing eddy of the second mixer disk row supplements and strengthens the eddies of the first mixer disk row.

If additional additives (e.g., ammonia or ammonia water in denitrification plants, so-called deNOx plants, $SO_3$ in the case of electrostatic filters, lime in coal boilers and the like) are to be incorporated into the first fluid which is flowing through the flow channel and is also referred to as the primary fluid, then an admixture device is installed downstream from the transverse mixer(s). This admixing device conveys the material to be admixed, hereinafter referred to as the secondary fluid, directly into the eddy system, which entrains the substance and mixes it thoroughly with the main stream. The substance to be admixed may be gaseous, in the form of a mist (aerosol) or a pulverized solid. With the known admixture devices, these may be narrow injection grids having numerous nozzles with which the additives are admixed and finely distributed in the primary fluid. These nozzle grids are installed at a minimum distance in front of any mixers. The minimum distance is selected to be large enough so that secondary fluid sprayed in is evaporated as completely as possible in the hot primary fluid before reaching the mixer because otherwise corrosion and erosion phenomena will develop on the mixers. These known mixing devices have already been used successfully for a long time. Nevertheless against the background of the further increase in demands regarding the efficiency of industrial plants, there is a demand for mixing equipment with a further boost in efficiency.

SUMMARY OF THE INVENTION

Therefore, the object of this invention is to create a mixing device which will have a further optimized efficiency.

This object is achieved with a mixer of the type defined in the preamble by arranging the mixer disk rows side by side in a common flow channel section, based on the main direction of flow, whereby the mixer disks of neighboring mixer disk rows are angled alternately in a positive approach angle of the main direction of flow and in a negative approach angle and in the case of a mixing method, this object is achieved by the fact that at least two leading edge eddy systems pointing in the same direction are created in a common flow channel section. Preferred refinements are described in the subclaims.

This is thus a mixing device which is arranged in a flow channel and has a plurality of mixer disks. These mixer disks create the leading edge eddies described above in a fluid flowing through the flow channel in a main direction of flow and they are arranged along the row axes in mixer disk rows, whereby the mixer disk rows run essentially across the main direction of flow. The mixer disks of the respective mixer disk row are in turn arranged in the same direction with respect to the main direction of flow of the fluid. Thus they extend essentially in the same direction, but they need not necessarily be aligned in parallel to one another but instead may have slight deviations or differences in their approach angles.

According to this invention these mixer disk rows are arranged side by side in a common flow channel section. The mixer disk rows are thus not arranged one after another at a minimum distance in the main direction of flow as has been customary in the past but instead, contrary to all conventional rules of arrangement, they are all mounted in one and the same section of flow channel. The mixer disk rows thus extend mainly over a section length of the flow channel running in the main direction of flow, this section length resulting from the maximum longitudinal extent of the largest mixer disk row. The other neighboring mixer disk rows then extend either over the same length or over a smaller length and are at least essentially within this flow channel section defined by the longest mixer disk row. The maximum longitudinal extent in this context is understood to be the length resulting from the leading edge of the front part and the trailing edge of the rear part of the mixing device in the main direction of flow. The leading edge is thus usually the leading edge of the foremost mixer disk, and the trailing edge is usually also the trailing edge of the last mixer disk, also referred to as the breakaway edge or separation edge.

The mixer disks of neighboring mixer disk rows are angled alternately in a positive and negative approach angle with respect to the main direction of flow according to this invention. The arrangement of the mixer disk rows divides the flow alternately into a flow component deflected in a positive direction, based on the main direction of flow, and a flow component deflected in a negative direction. Therefore, a view of such a mixing device from above shows an intersecting flow pattern. Furthermore, the mixer disks not only create an eddy-like cross-flow due to the leading edge eddy systems on the backs of the mixer disks, but, due to the simultaneous deflection of the flow on their leading edges, these mixer disks also produce a rotating global flow across the main direction of flow. The entire fluid flow is offset over the entire cross-sectional width of the channel in rotation about the longitudinal axis of the channel. The result is a global spiral twist in the flow which permits especially effective mixing of fluid. This invention has the advantage that hot spots and out-of-balance temperatures are also blended.

The mixing of the fluids on the basis of this special stacking and/or stratification of the flow is accomplished much more efficiently than is the case with the sequential series of transverse mixers known in the past. It has been found that the mutually interpenetrating leading edge eddy systems of the inventive mixing device do not mutually hinder one another. Furthermore, the inventive mixing device takes up a great deal of space because the individual mixer disk rows are not arranged one after the other at a minimum distance to one another to ensure the specific efficiency of the individual mixer disk rows. This compact design of the inventive mixing device is another advantage because the available space is often very tight, especially in large-scale installations, which usually take up all available space.

In a preferred refinement of the inventive mixing device, the mixer disk rows are arranged one above the other. Thus the mixer disk rows run essentially side by side but rotated by 90°; in other words, both rows extend in the horizontal direction. It is also expedient if the axes of the rows of neighboring mixer disk rows are arranged in planes that are spaced a distance apart and run essentially parallel to the main direction of flow. The row axes are arranged in such a way that they do not intersect but they run crosswise to one another when viewed from above.

It is also advantageous if the axes of the rows of neighboring mixer disk rows are angled alternately in a positive and negative direction of alignment with respect to the main direction of flow. The alignment angle is understood to be the angle between the row axis and the main direction of flow. The main direction of flow is obtained in a known way essentially from the path of the channel walls upstream from, around and downstream from the mixing device. It is usually in the center-of-gravity line of the channel cross section that is extending in the longitudinal direction.

The row axes are arranged in separate planes at a distance from one another extending essentially parallel to the main direction of flow. They expediently pass through the centers of gravity of the individual mixer disks. Alternatively, however, a row axis may also connect the front point of the respective mixer disk row in the direction of flow or other suitable points for achieving a uniform orientation of multiple different mixer disks. For example, mixer disks of different lengths may all be aligned at their leading edges and then the row axis will run through the respective leading edges.

The row axes are preferably arranged with an inclination in their planes in an alignment angle of 75 to 90° and/or −75 to −90° with respect to the main direction of flow. Thus the two row axes may have a negative or positive alignment angle or may have one positive angle and one negative angle in alternation.

In a refinement of this invention, the row axes run parallel to one another. This yields a particularly uniform flow pattern in particular downstream form the mixer disk rows. The same thing is also true when the mixer disk rows are arranged symmetrically with one another. This may involve point symmetry or axial symmetry with respect to the center of gravity of the flow channel or the main direction of flow.

In a preferred embodiment of the mixing device according to this invention, at least one mixer disk row has a curved row axis. This is advantageous in the case of complex channel geometries of the flow channel when the flow of the fluid is to be guided into certain areas of the flow channel or parts of the flow are to be mixed to a greater or lesser extent. The curved row axis may have, for example, a constant radius of curvature in the case of an arc section. A variable curvature may also be expedient, in particular a parabolic curve. In the case of such a curvature, a portion of the mixer disk row axis runs almost parallel to the main direction of flow but most of the mixer disk row axis runs across the main direction of flow. If the beginning and end point of such a mixer disk row axis are connected, this extends in the sense of this invention essentially across the main direction of flow. The approach angles of the mixer disks are preferably selected to be larger with a decrease in the curvature of the row axis.

It is particularly expedient if all the mixer disk rows have the same curvature. Here again the result is uniform mixing of the flow which is expedient in particular in the case of straight channel sections.

The inventive mixing device preferably has a first row axis with a first curvature and a second row axis with a second curvature, whereby the second curvature corresponds to a reflection of the first curvature. The curvature is reflected on the center of gravity axis of the flow channel.

The mixer disk rows preferably each have the same number of mixer disks. It is also advantageous if all the mixer disks of one mixer disk row have the same shape. This permits advantageous mass production of the mixer disks. It is also very easy to orient the mixer disks on site because the same mixer disks can be mounted in the same way and have the same alignment.

Depending on the channel geometry, it may be desirable if the mixer disks of one mixer disk row are arranged so they are partially overlapping with respect to the main direction of flow. When viewing in the main direction of flow, the mixer disks of such an overlapping mixer disk row then cover one another. In the area of the overlapping, the rear mixer disk is thus in the flow shadow of the mixer disk mounted in front of it. In the case of particularly complex channel geometries, the overlapping of the individual mixer disks will vary in one mixer disk row. It is expedient here if the overlapping of the individual mixer disks with a smaller curvature or inclination of the row axis with respect to the main direction of flow increases.

Preferably at least one mixer disk has a triangular shape. The term triangular shape is understood here to refer mainly to a thin disk having a triangular base area. Additionally or alternatively, at least one mixer disk may have a roundish shape, in particular a circular, elliptical or overall shape. For optimum flow separation, it is expedient if at least one roundish mixer disk is flattened on its side facing away from the main direction of flow. Furthermore an inventive mixing device has at least one mixer disk having a trapezoidal shape. Then the narrower side is the side of the mixer disk facing the flow. The leading edge producing the leading edge eddies is then an angular "U" with widening legs, whereas in the case of a triangular disk it is a "V" and in the case of a circular disk it is an arc section.

To further support the development of leading edge eddies and reduce the flow resistance, it is expedient if at least one mixer disk has at least one kink in its oncoming flow surfaces. This kink should not be too pronounced, so that even with the kink, a relatively flat oncoming flow surface of the mixer disk is still preserved. The surface is then expediently designed with a kink toward the rear in the direction of flow. The pointed side of the kink is thus facing the flow. Again in this sense, multiple kinks may also form an angle in the surface in the direction of flow.

In a particularly preferred embodiment of the inventive mixing device, an admixing device having at least one outlet opening for a second fluid may also be arranged in the same flow section of the flow channel in which the mixer disk rows extent. Unlike the state of the art in the past, a combination of multiple transverse mixers with an admixing devices [sic] in one and the same channel section is employed. It has been found that the flow resistance of the inventive mixing device is lower than the sum of the individual flow resistances of the respective mixing rows and the admixing device. To further reduce the flow resistance, the admixing device may also be used for mounting the mixer disks.

In advantageous embodiment of the mixing device with an admixing device, at least one outlet pipe is arranged between two neighboring mixer disk rows with the at least one outlet opening situated in this outlet pipe. The secondary fluid flows through this outlet pipe and is sprayed into the primary fluid through the at least one outlet opening. The outlet pipe of the admixing device should be adapted exactly to the geometry of the mixer disk row and should expediently run as parallel as possible to the row axes in the area of the leading edges of the mixer disks. In particular, this embodiment has the advantage that the secondary fluid admixed to the primary fluid is distributed especially finely and uniformly downstream due to the leading edge eddies of the individual mixer disks. In addition, with this arrangement the corrosion and erosion problems described in the beginning are eliminated, especially when the fluid is sprayed onto the leeward side of the mixer disks.

For further homogenization of the primary fluid enriched with the admixed secondary fluid, at least one outlet opening of the admixing device is assigned to each mixer disk. This means that at least one outlet opening of the admixing device is situated in the area of each individual mixer disk and specifically is situated there as far forward as possible in the area of the leading edge. This yields an especially fine distribution of the secondary fluid in the flow of the first fluid.

In a particularly preferred embodiment, each mixer disk is assigned its own outlet pipe of the admixing device. Then each mixer disk may be mounted in the flow channel in a particularly simple manner. To do so, the mixer disk is connected by screws, a welded joint or some other suitable method to the respective outlet pipe.

The inventive mixing method is thus characterized in that at least two oppositely aligned leading edge eddy systems are generated in a joint flow channel section. The leading edge eddy systems, each consisting of pairs of leading edge contra-rotating eddies rotating inward are thus aligned in alternation in relation to the main direction of flow, i.e., in a positive angle in one case and in a negative angle in another case. This has the advantage that effective and thorough mixing of the fluid is achieved in a particularly short mixing zone.

In a preferred embodiment of the inventive mixing method, a global flow rotating in the main direction flow is generated together with the two contra-rotating leading edge eddy systems. Superimposing the global flow on the leading edge eddy systems yields a further increase in the mixing effect of the fluid flows. In generating the contra-rotating leading edge eddy systems, at least one additional secondary fluid is added to the first fluid in applications such as denitrification of exhaust gas in which another fluid flow is to be sprayed into the main flow. Contrary to what has been customary in the past, the mixing of the fluid thus takes place simultaneously with the addition of the secondary fluid. As explained above in conjunction with the mixing device, this leads to a further increase in the efficiency of the inventive mixing method.

BRIEF DESCRIPTION OF THE DRAWINGS

This invention will be further explained below on the basis of exemplary embodiments depicted in the drawing. They show schematically.

DETAILED DESCRIPTION

Figure 1:
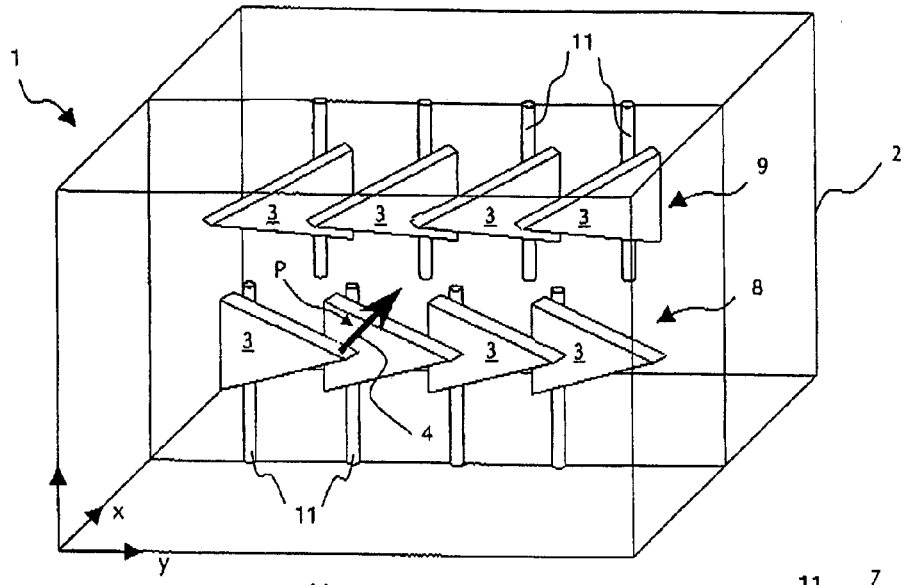
FIG. 1 shows a three-dimensional representation of a flow channel in which a first exemplary embodiment of a mixing device is situated.

The first embodiment of the inventive mixing device 1 shown in FIG. 1, FIG. 2, FIG. 3 and FIG. 4 is arranged in a rectangular flow channel 2 and has eight mixer disks 3 with a triangular base area. The flow channel 2 has a fluid P flowing through it in the main direction of flow 4. In the case of the channel 2 shown here, the main direction of flow runs in the direction of the longitudinal axis of the channel in the X direction and the channel width runs across it in the direction of the Y axis while the channel height runs in the Z direction.

The mixer disks 3 are arranged at an angle $\pm\alpha$ with respect to the main direction of flow 4. They therefore create leading edge eddies 5 on their leeward side facing away from the flow, these eddies propagating downstream in a conical pattern widening across the main direction of flow 4. The leading edge eddies 5 then develop a leading edge eddy system 14 behind each mixer disk 3, involving two contra-rotating eddies 5 rotating toward the center of the mixer disk 3; these are very stable and strong eddies.

The mixer disks 3 are arranged one above the other in mixer disk rows 8, 9 along two row axes 6, 7. The mixer disk rows 8, 9 are also situated in a common flow channel section 10, whereby the two mixer disk rows 8, 9 are of equal length.

Figure 4:
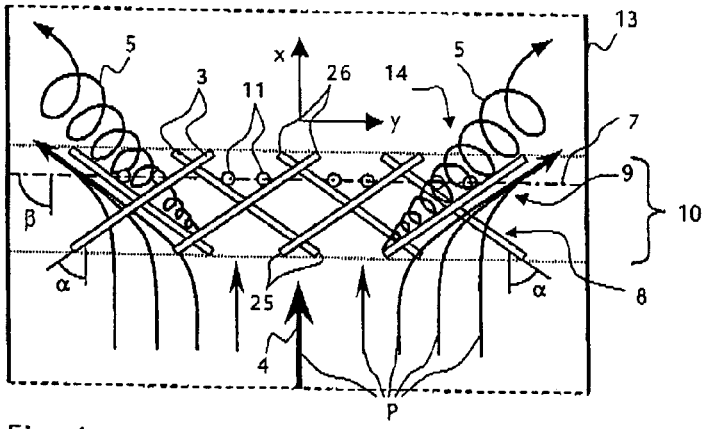
FIG. 4 shows a two-dimensional view from above of the flow channel depicted in FIG. 1.

As shown in the view of the inventive mixing device 1 from above in FIG. 4, the mixer disks 3 of the mixer disk row 8 situated beneath the mixer disk row 9 are arranged at a positive angle $\alpha$ with respect to the main direction of flow 4. The positive angle $\alpha$ refers to a positive angle in a mathematical sense, i.e., an angle rotating counterclockwise. The mixer disks 3 of the mixer disk row 9 situated above it are arranged accordingly at a negative angle $\alpha$ with respect to the main direction of flow 4.

The row axes 6, 7 of the neighboring mixer disk rows 8, 9 in turn run parallel to one another and across the main direction of flow 4. Therefore, in FIG. 4, the row axis 6 of the lower mixer disk row 8 is covered by the row axis 7 of the upper mixer disk row 9. In the present exemplary embodiment, the alignment angle $\beta$ of the two row axes 6, 7 is exactly 90° in each case. The row axes 6, 7 are in two planes running in x and y directions with different z coordinates extending parallel to the main direction of flow 4, whereby the row axes 6, 7 run only in the y direction, i.e., they both have the x coordinate.

Figure 2:
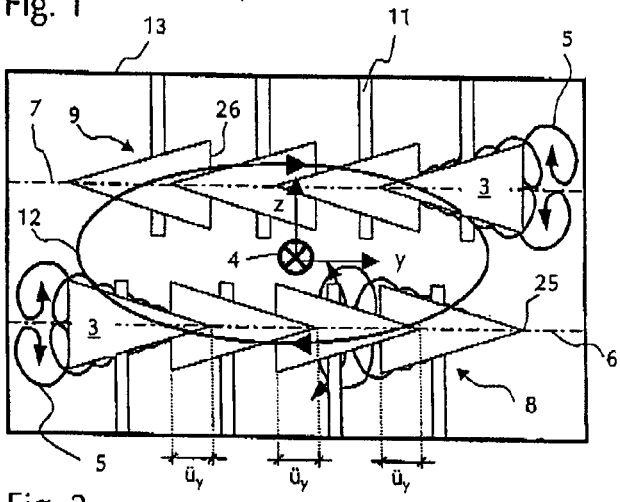
FIG. 2 shows the two-dimensional view of the flow channel depicted in FIG. 1 as seen in the direction of the longitudinal axis of the channel.
Figure 3:
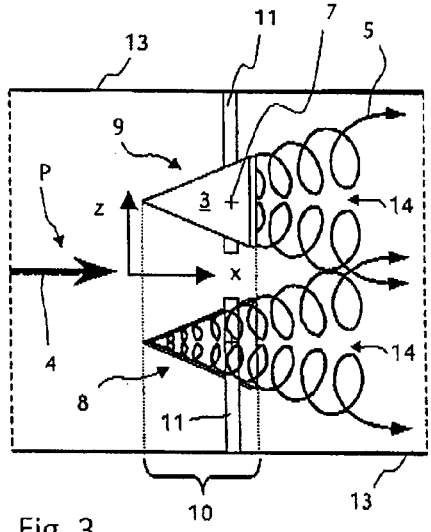
FIG. 3 shows a two-dimensional side view of the flow channel shown in FIG. 1.

The mixer disks 3 are each mounted on a mounting pipe 11 in a rotationally fixed mount such that they overlap with respect to the main direction of flow 4. As shown in FIG. 2, the mixer disks 3 all have the same shape and overlap by an equal measure $\ddot{u}_y$ in the y direction. The overlapped $\ddot{u}_y$ in the lower mixer disk row 8 are exactly as large as the overlaps in the mixer disk row 9.

Mixing of the fluid P flowing through the flow channel 2 in the main direction of flow 4 now takes place in such a way that the mixer disks 3 deflect the flowing fluid from their tip 25 toward the broad trailing edge 26 across the main direction of flow 4 in the direction of the channel 13. At the same time, leading edge eddy systems 14 develop on the leeward side of the mixer disks 3 facing away from the flow. These leading edge eddy systems 14 are situated behind each mixer disk 3. They are not depicted behind each mixer disk 3 in FIGS. 1 through 9 merely for reasons of simplicity.

As shown in FIG. 2, the leading edge eddy systems 14 of the lower mixer disk row 8 propagate toward the left in the drawing and those of the upper mixer disk row 9 propagate to the right. Based on the local coordinate system depicted in FIG. 2, the lower leading edge eddy systems 14 run in a negative y direction while the upper leading edge eddy systems 14 of the mixer disk row 9 run in a positive y direction. Thus the mixer disks 3 deflect the flow with their leading edge facing the flow and at the same time create eddies on their side facing away from the flow. They thus have a deflecting and eddy generating effect. Because of this specific arrangement of the two mixer disk rows 8 and 9, a right-handed spiral about the longitudinal axis of the channel is created in the entire flow, referred to here as a rotating global flow 12. This global flow 12 ensures a good and thorough mixing of the fluid P from one side of the channel to the other.

A second exemplary embodiment of the inventive mixing device 1 is shown in FIG. 5, FIG. 6, FIG. 7 and FIG. 8. This differs from the first exemplary embodiment mainly in the alignment of the mixer disk rows 8, 9. The mixer disk axes 6, 7 here run alternately in a positive alignment angle $\beta$ or a negative alignment angle $\beta$, resulting in a cross-type arrangement of the mixer disk rows 8, 9 as seen from above according to FIG. 8. The two mixer disk rows 8, 9 are arranged symmetrically with the longitudinal axis of the channel, so that the row axes 6, 7 intersect at the middle of the channel. In the present case the angle $\beta$ amounts to about 80°.

Figure 5:
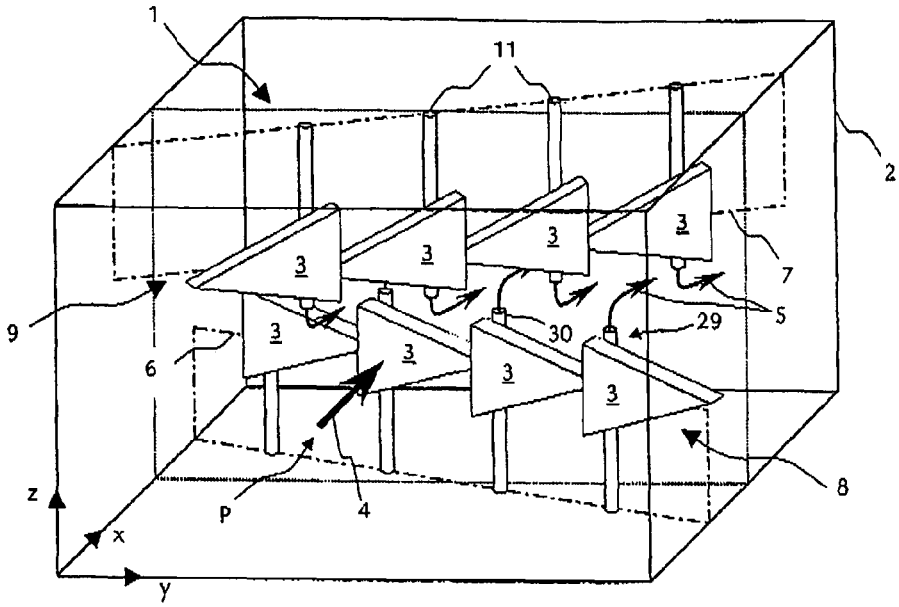
FIG. 5 shows a three-dimensional diagram of a flow channel in which a second exemplary embodiment of the inventive mixing device is situated.
Figure 6:
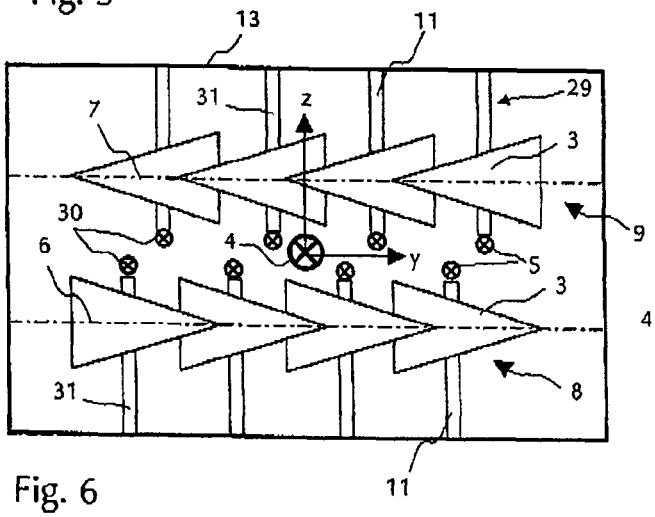
FIG. 6 shows a two-dimensional view of the flow channel depicted in FIG. 5 as seen in the direction of the longitudinal axis of the channel with a second exemplary embodiment of a mixing device.
Figure 7:
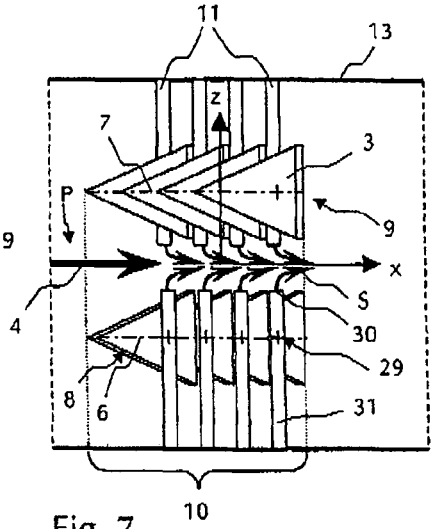
FIG. 7 shows a two-dimensional side view of the flow channel shown in FIG. 5 with the second exemplary embodiment of the mixing device.
Figure 8:
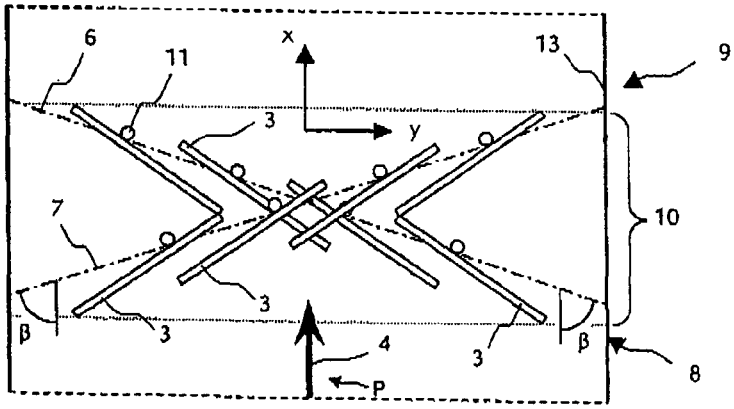
FIG. 8 shows a two-dimensional view from above of the flow channel shown in FIG. 5 with the second exemplary embodiment of the mixing device.

As FIG. 5 also shows, the mounting pipes 11 of the mixer disks 3 form the admixing device 29 for the secondary fluid S. This means that in this embodiment, the mounting pipes 11 have the secondary fluid S flowing through them. The channel-side ends of the mounting pipes 11 thus form the outlet openings 30 of the admixing device 29. At the same time the mounting pipes 11 are also the outlet pipes 31 of the admixing device 29. This admixing device 29 thus has exactly as many outlet pipes 31 and outlet openings 30 as mixer disks 3. The mounting pipes 11 thus serve to mount the individual mixer disks 3 in the flow channel 2 and also to guide and admix a secondary fluid S into the flow of the first fluid P.

Figure 9:
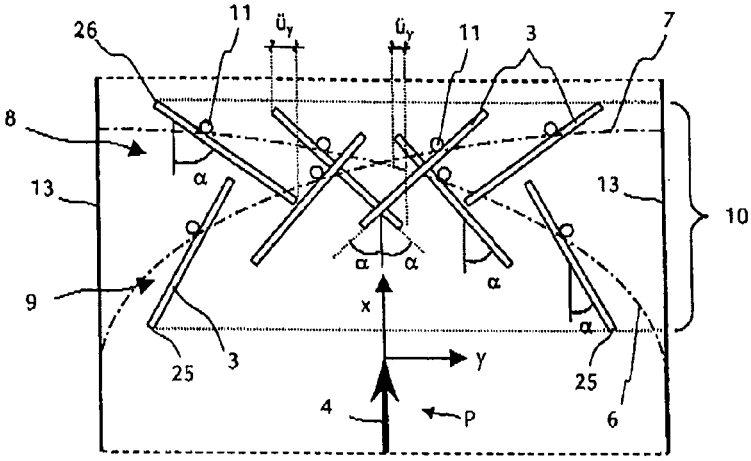
FIG. 9 shows a two-dimensional view from above of a flow channel with a third exemplary embodiment of the mixing device.
Figure 10:
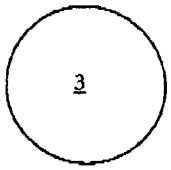
FIG. 10 shows a mixer disk having a circular base area.

In the third exemplary embodiment of the inventive mixing device 1 shown in FIG. 9, the row axes 6, 7 have a parabolic curve. The upper row axis 7 has its more curved part on the left side of the flow channel 2, and the lower row axis 6 has its part with the greater curve on the right side of the flow channel 2. The mixer disks 3 are arranged along each row axis 6, 7 so that the angles of attack $\alpha$ increase from the part having the greater curvature to the part of a row axis 6, 7 having a weaker curvature.

In this exemplary embodiment, the distance between the individual mixer disks in each mixer disk row 6, 7 are selected so that the overlap $\ddot{u}_y$ decreases with an increase in the curvature of the row axis 6, 7. As in the preceding exemplary embodiments, the mixer disks 3 in this exemplary embodiment as well are arranged along the row axes 6, 7 symmetrically with the main direction of flow 4 running in the x direction at the midpoint of the channel. The row axes 6, 7 arranged one above the other thus intersect in the middle of the flow channel 2 as seen in the view from above in FIG. 9.

Figure 11:
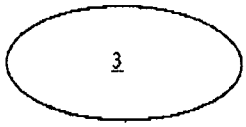
FIG. 11 shows a mixer disk having an ellipsoidal base area.
Figure 12:
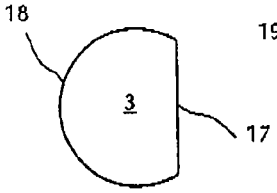
FIG. 12 shows a mixer disk having a base area in the shape of the segment of an arc.
Figure 13:
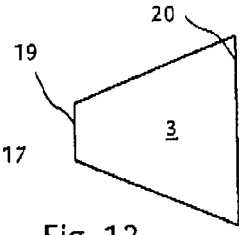
FIG. 13 shows a mixer disk having a trapezoidal base area.

Various embodiments of mixer disks 3 are shown in FIG. 10 through FIG. 17. In the case of the mixer disk 3 shown in FIG. 10, this is a disk having a circular base area. The disk shown in FIG. 11 has an elliptical base area. The disk shown in FIG. 12 is also a roundish mixer disk although this one has a flattened trailing edge 17. The mixer disk 3 is to be arranged in the flow so that the roundish leading edge 18 is directed against the flow and the flattened trailing edge 17 is facing away from the flow. The mixer disk 3 shown in FIG. 13 has a trapezoidal base area, with the narrower leading side 19 being directed against the flow and the broader trailing edge 20 facing away from the flow. The mixer disk shown in FIG. 13 thus has medium flowing around it from left to right, like the mixer disk 3 shown in FIG. 12.

Figure 14:
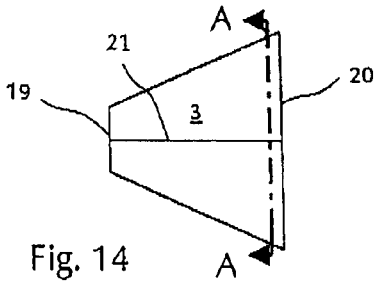
FIG. 14 shows a mixer disk having a trapezoidal base area and a kink.
Figure 15:
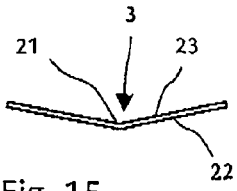
FIG. 15 shows section A-A indicated in FIG. 14.

Another embodiment of a trapezoidal mixer disk 3 is shown in FIG. 14 and FIG. 15 where the mixer disk 3 has a kink 21 extending in the direction of flow in the middle of the base area of the mixer disk 3. The kink 21, as can be seen in FIG. 15, runs so that the side 22 of the mixer disk 3 facing the flow drops slightly toward the rear in the direction of flow while the top side of the mixer disk 3 facing away from the flow is concave. This shape intensifies the leading edge eddies and thus results in a mechanical stabilization of the mixer disk 3.

Figure 16:
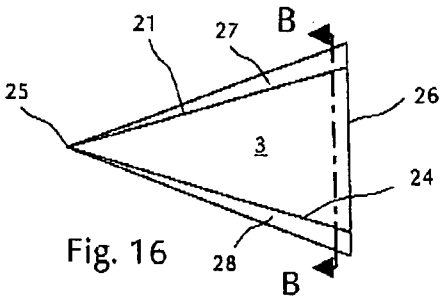
FIG. 16 shows a mixer disk having a triangular base area and two kinks.
Figure 17:
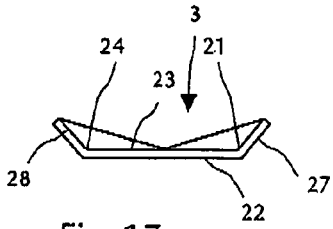
FIG. 17 shows section B-B indicated in FIG. 16.

Another embodiment of a mixer disk 3 is shown in FIG. 16 and FIG. 17, having a triangular base area as seen from above but also having two kinks 21 and 24 running radially from the tip 25 to the trailing edge 26 so that the widths of the unfolded sides 27 and 28 become larger in the direction of flow. FIG. 17 shows section B-B indicated in FIG. 16; this shows the two angled positions of sides 27 and 28. The mixer disk 3 shown in FIGS. 16 and 17 is aligned in the flow exactly like the mixer disk shown in FIGS. 14 and 15. The surface 22 of the mixer disk 3 receiving the oncoming flow is angled with respect to the flow on its side edges while the middle is straight. The top side 23 of the mixer disk 3 facing away from the flow is again concave.

Figure 18:
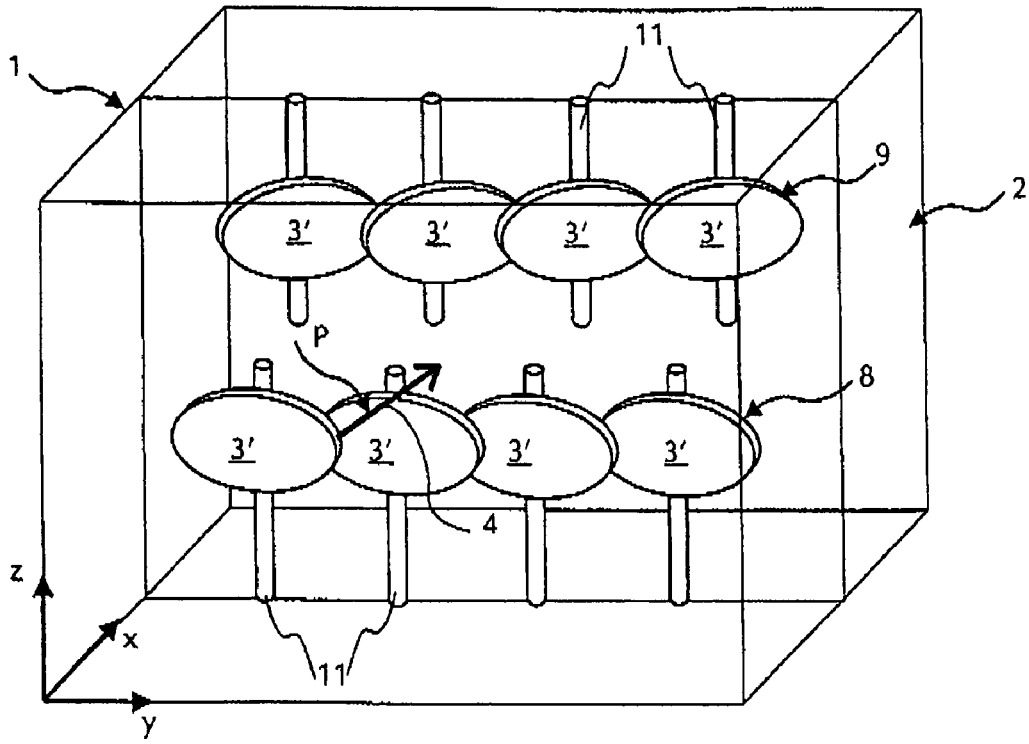
FIG. 18 shows a three-dimensional diagram of a fourth exemplary embodiment of a mixer device.

The fourth exemplary embodiment of a mixing device illustrated in FIG. 18 differs from the first exemplary embodiment illustrated in FIG. 1 in that the mixer disks 3' have an elliptical base area, as shown in FIG. 11. Otherwise the design corresponds to the example depicted in FIG. 1.

What is claimed is:

1. A mixing device, comprising a flow channel and a plurality of mixer slices being arranged in the flow channel, for creating leading edge eddies in a fluid flowing through the flow channel in a main direction of flow, whereby said mixer slices are arranged in individual mixer slices rows along row axes running essentially across the main direction of flow, and the mixer slices of each individual mixer slices row are angled in the same direction with respect to the main direction of flow and are situated partially overlapping in relation to the main direction of flow;

wherein the individual mixer slices rows are arranged side by side in a common flow channel section based on the main direction of flow, whose lengths correspond to the maximum longitudinal dimension of the largest mixer plate row, whereby the mixer slices of neighboring individual mixer slices rows are angled contrary to each other in a positive angle of attack ($+\alpha$) and in a negative angle of attack ($-\alpha$) with respect to the main direction of flow, and whereby the row axes of the same neighboring individual mixer slices rows are further angled contrary to each other in a positive angle of alignment ($+\beta$) and in a negative angle of alignment ($-\beta$) with respect to the main direction of flow, wherein the alignment angle ($\beta$) is understood to be the angle between a row axis of an individual mixer slices row and the main direction of flow.

2. The mixing device according to claim 1, wherein said mixer slices rows are arranged one above the other.

3. The mixing device according to claim 1, wherein the row axes of neighboring mixer slice rows are arranged in planes neighboring to one another and extending essentially parallel to the main direction of flow.

4. The mixing device according to claim 1, wherein the row axes of the mixer slices rows are arranged so they are inclined in an alignment angle ($\beta$) of 75° to 90° and ($\beta$) −75° to −90° with respect to the main direction of flow.

5. The mixing device according to claim 1, wherein said mixer slices rows are arranged symmetrically to one another.

6. The mixing device according to claim 1, wherein each of the mixer slices rows have an equal number of mixer slices.

7. The mixing device according to claim 1, wherein all of the mixer slices of a mixer slice row have the same shaping.

8. The mixing device according to claim 1, wherein an overlap ($\ddot{u}_y$) of the individual mixer slices varies by mixer slices row.

9. The mixing device according to claim 1, wherein at least one mixer slice has a triangular shape.

10. The mixing device according to claim 1, wherein the least one mixer slice has a roundish shape chosen from a circular, elliptical or oval shapes.

11. The mixing device according to claim 10, wherein the at least one roundish mixer slice is flattened on its side facing away from the main direction of flow.

12. The mixing device according to claim 1, wherein at least one mixer slice has a trapezoidal shape.

13. The mixing device according claim 1, wherein at least one mixer slice has at least one kink in its surface that is exposed to the oncoming flow.

14. The mixing device according to claim 1, wherein an admixing device having at least one outlet opening for a secondary fluid (S) is arranged in the same flow cross section of the flow channel in which the mixer slice rows extend.

15. The mixing device according to claim 14, wherein the mixer slices are mounted on the admixing device.

16. The mixing device according to claim 14, wherein at least one outlet pipe is arranged between two neighboring slice rows with at least one outlet opening for the secondary fluid (S) being situated in the outlet pipe.

17. The mixing device according to claim 16, wherein at least one outlet pipe in which there is at least one outlet opening for the secondary fluid (S) is arranged parallel to each mixer slice row.

18. The mixing device according to claim 16, wherein each mixer slice is assigned at least one outlet opening of the admixing device.

19. The mixing device according to claim 15, wherein each at least one mixer slice is assigned its own outlet pipe of the admixing device.

20. A mixing device, comprising a flow channel and a plurality of mixer slices being arranged in the flow channel, for creating leading edge eddies in a fluid (P) flowing through the flow channel in a main direction of flow, whereby said mixer slices are arranged in individual mixer slices rows along row axes running essentially across the main direction of flow, and the mixer slices of each individual mixer slices row are angled in the same direction with respect to the main direction of flow, and are situated partially overlapping in relation to the main direction of flow wherein the individual mixer slices rows are arranged side by side in a common flow channel section based on the main direction of flow, whose lengths correspond to the maximum longitudinal dimension of the largest mixer plate row, whereby the mixer slices of neighboring individual mixer slices rows are angled contrary to each other in a positive angle of attack ($+\alpha$) and in a negative angle of attack ($-\alpha$) with respect to the main direction of flow so that a global rotating fluid flow in the main direction of flow is generated being superimposed with two contra-rotating leading edge eddies, and whereby the row axes of the same neighboring individual mixer slices rows are further angled contrary to each other in a positive angle of alignment (+β) and in a negative angle of alignment (−β) with respect to the main direction of flow for supporting the global rotating fluid flow, wherein the alignment angle (β) is understood to be the angle between a row axis of an individual mixer slices row and the main direction of flow.

21. A mixing device, comprising a flow channel and a plurality of mixer slices being arranged in the flow channel, for creating leading edge eddies in a fluid (P) flowing through the flow channel in a main direction of flow, whereby said mixer slices are arranged in individual mixer slices rows along row axes running essentially across the main direction of flow, and the mixer slices of each individual mixer slices row are angled in the same direction with respect to the main direction of flow, and are situated partially overlapping in relation to the main direction of flow wherein the individual mixer slices rows are arranged side by side in a common flow channel section based on the main direction of flow, whose lengths correspond to the maximum longitudinal dimension of the largest mixer plate row, whereby the mixer slices of neighboring individual mixer slices rows are angled contrary to each other in a positive angle of attack (+α) and in a negative angle of attack (−α) with respect to the main direction of flow, and whereby the row axes of the same neighboring individual mixer slices rows are further angled contrary to each other in a positive angle of alignment (+β) and in a negative angle of alignment (−β) with respect to the main direction of flow resulting in a cross-type arrangement of the mixer slices rows, wherein the alignment angle (β) is understood to be the angle between a row axis of an individual mixer slices row and the main direction of flow.

* * * * *